US005477693A

United States Patent [19]

Morita

[11] Patent Number: 5,477,693

[45] Date of Patent: Dec. 26, 1995

[54] METHOD AND APPARATUS FOR COOLING AN OXIDE SUPERCONDUCTING COIL

[75] Inventor: Mitsuru Morita, Kawasaki, Japan

[73] Assignee: Nippon Steel Corporation, Tokyo, Japan

[21] Appl. No.: 962,231

[22] PCT Filed: May 25, 1992

[86] PCT No.: PCT/JP92/00673

§ 371 Date: Jan. 27, 1993

§ 102(e) Date: Jan. 27, 1993

[87] PCT Pub. No.: WO92/22077

PCT Pub. Date: Oct. 12, 1992

[30] Foreign Application Priority Data

May 28, 1991 [JP] Japan ..... 3-150882

[51] Int. Cl.[6] ..... F27B 19/00

[52] U.S. Cl. ..... 62/63; 62/51.1

[58] Field of Search ..... 62/47.1, 51.1, 62/63; 505/1

[56] References Cited

U.S. PATENT DOCUMENTS

| | | | |
|---|---|---|---|
| 3,994,141 | 11/1976 | Schrawer | 62/51.1 X |
| 4,500,771 | 4/1985 | Matsuda et al. | 62/51.1 |
| 4,689,439 | 8/1987 | Sato | 62/51.1 X |
| 4,773,228 | 9/1988 | Murai et al. | 62/51.1 X |
| 4,872,314 | 10/1989 | Asano et al. | 62/51.1 X |
| 4,967,564 | 11/1990 | Strasser | 62/47.1 |
| 5,038,571 | 8/1991 | Yokogouchi et al. | 62/51.1 X |
| 5,163,297 | 11/1992 | Yani et al. | 62/47.1 |
| 5,270,291 | 12/1993 | Sun et al. | 505/1 |

FOREIGN PATENT DOCUMENTS

| | | |
|---|---|---|
| 2423681 | 9/1975 | Germany . |
| 3633313 | 4/1987 | Germany . |
| 63-224269 | 9/1988 | Japan . |

OTHER PUBLICATIONS

Sun et al., "Elimination of Current Dissipation in High Transition Temperature Superconductors", Science, vol. 247, 19 Jan. 1990, pp. 307–309.

Hamzic et al., "Non-activated Magnetic Relaxation in a High Tc Superconductor", Nature, vol. 345, 7 Jun. 1990, pp. 515–516.

Yeh et al., "Persistent Current in Ba–Y–Cu–O in Liquid Nitrogen", Phys. Rev. B, vol. 36(4), 1 Aug. 1987, pp. 2414–2416.

Ferguson et al., "Magnetic Measurements of Critical Currents in High Tc Superconductors", Cryogenics, vol. 28, Oct. 1988, pp. 688–690.

*Primary Examiner*—Christopher Kilner

*Attorney, Agent, or Firm*—Kenyon & Kenyon

[57] ABSTRACT

A method and an apparatus for cooling an superconducting material below the boiling point of liquid nitrogen by using liquid nitrogen as coolant. The cooling method of the invention can be used in two different modes, one under reduced pressure and the other under the atmospheric pressure. The former comprises a coil container which is in fact a vacuum vessel and the temperature of which is lowered by to the triple point of nitrogen by means of a vacuum pump. The latter comprises a coil container containing therein a cooling section of a freezer and the temperature of the coil container is lowered to the melting point of nitrogen by the freezer.

6 Claims, 5 Drawing Sheets

METHOD AND APPARATUS FOR COOLING AN OXIDE SUPERCONDUCTING COIL

FIELD OF THE ART

This invention relates to a method and an apparatus for cooling an oxide superconducting coil or a bulk superconducting material and is intended to provide a technology of cooling oxide superconducting coils at temperature lower than the boiling point of liquid nitrogen under the atmospheric pressure and preventing the creep phenomenon of the magnetic flux of a superconducting coil.

BACKGROUND OF THE INVENTION

A superconducting material exhibits its superconductivity at and below its critical temperature (Tc) and oxide superconducting materials having a relatively high critical temperature (Tc) are expected to find applications at the boiling point, or 77 K., of liquid nitrogen. Two methods are generally used for cooling superconducting materials. One involves the use of a freezer and the other utilizes liquid helium or nitrogen as a medium of freezing. The latter is normally recommended for cooling superconducting coils and bulk superconducting materials from the viewpoints of rapid conduct ion of heat, enhanced thermal conductivity and even distribution of heat. Liquidized helium is often used under reduced pressure at temperature below 2.19 K. to keep it in a superfluid state. In view of the above described facts and other considerations, the temperature at which a bulk oxide superconducting material is used is preferably 2.19 K., 4.2 K. or 77 K.

A superconducting material normally needs to be cooled considerably below its critical temperature in order to ensure its desired properties in a stable manner under high electric current density condition. While the use of liquid helium (2.19 K., 4.2 K.) as cooling medium provides an advantage of increased critical electric current density when compared with the use of liquid nitrogen, it is accompanied by the disadvantage of high cost and difficulty of handling. As for the use of liquid nitrogen (77 K.), on the other hand, there has been a report that a QMG material prepared by a quench and melt growth method and cooled by liquid nitrogen (77 K.) exhibited a Jc value of 30,000 A/cm$^2$ in a magnetic field of 1 T ("New Superconducting Materials Forum News"; No. 10, p. 15) and another report says that a Jc value as high as 4,000 A/cm$^2$ has been achieved by using a Bi-type silver-sheathed wire, suggesting that such superconducting materials may find practical applications in near future. It is widely recognized, however, that a new or improved cooling method has to be proposed that can cool oxide superconducting materials below 77 K. in a stable manner, using easily handled liquid nitrogen as cooling medium so that the superconducting properties of such materials may be fully exploited.

It has also been reported that a maximum magnetic flux density of 1.35 X $10^{-2}$ T was achieved at 77 K. by a bulk magnet made of a QMG material but it was accompanied by creep phenomenon in the magnetic flux of the QMG material that gradually attenuates the density of magnetic flux with time. Therefore, there is also urgent need for a remedy for such creep.

Disclosure of the Invention

In view of the above described problems, it is therefore an object of the present invention to provide a method and an apparatus for cooling a bulk oxide superconductive material or a bulk magnet by using liquid nitrogen which is available at low cost and easy to handle.

The present invention essentially has two aspects. In one aspect, it provides means of stably cooling a superconducting body to the triple point temperature (63.1 K.) of nitrogen which is obtained by cooling nitrogen by reducing pressure and, in the other, it provides means of stably cooling a superconducting body at approximately 63.9 K. under the atmospheric pressure by utilizing the latent heat of phase transition of nitrogen involving liquid and solid phases.

More specifically, according to the first aspect of the present invention, the above object is achieved by providing a method for cooling an oxide superconducting coil and stably keeping it at a constant temperature, comprising steps of introducing liquid nitrogen into a coil container, and reducing the inside pressure of the coil container by pumping means to cool the nitrogen to the triple point temperature (63.1 K.). Alternatively, the object of the invention is achieved by providing a method for cooling an oxide superconducting coil and stably keeping it to constant temperature for a prolonged period of time, comprising steps of introducing liquid nitrogen into a coil container, reducing the inside pressure of the coil container by a pumping means to cool the nitrogen to the triple point temperature (63.1 K.), stably keeping the superconducting coil to that temperature, while introducing liquid nitrogen into a prevacuum chamber, reducing the inside pressure of the prevacuum chamber to cool the nitrogen to the triple point temperature of nitrogen, and the coil container being repeatedly supplied with the additional cooled nitrogen of the prevacuum chamber.

With respect to the prevention of the creep phenomenon in the magnetic flux, the above object is achieved by providing a method for cooling an oxide superconducting coil by using liquid nitrogen and avoiding the creep phenomenon in the magnetic flux, comprising steps of magnetically exciting the superconducting coil in a coil container above 63.1 K. by adjusting the inside pressure of the coil container, and lowering thereafter the inside temperature of the coil container to 63.1 K. by reducing the inside pressure.

According to the second aspect of the present invention, the above object is achieved by providing a method for cooling an oxide superconducting coil and stably keeping it to constant temperature, comprising steps of introducing liquid nitrogen into a coil container, and thereafter cooling the inside of the container by freezing means near to the melting point (63.9 K.) of nitrogen under the atmospheric pressure.

According to this aspect of the invention, the prevention of the creep phenomenon in the magnetic flux is achieved by providing a method for cooling an oxide superconducting coil by using liquid nitrogen under the atmospheric pressure and avoiding the creep phenomenon in the magnetic flux, comprising steps of magnetically exciting the superconducting coil in a coil container above 63.9 K. by adjusting the inside temperature of the coil container by freezing means, and thereafter reducing the inside temperature of the coil container near to 63.9 K.

Alternatively, the prevention of the creep phenomenon in the magnetic flux is achieved by providing a method for cooling an oxide superconducting coil by using liquid nitrogen and avoiding the creep phenomenon in the magnetic flux, comprising steps of magnetically exciting the superconducting coil in a coil container at or below 92 K. tinder pressure above the atmospheric pressure, and thereafter further cooling the coil container by leaking or releasing the inside pressure of the coil container to temperature below the temperature at which the magnetic excitation has terminated.

DETAILED DESCRIPTION OF THE BEST MODES OF CARRYING OUT THE INVENTION

According to the invention, a superconducting body is stably kept below the boiling point of nitrogen under the atmospheric pressure by allowing the solid and liquid phases of nitrogen coexist.

The triple point of nitrogen is 63.1 K. and this temperature can be reached by reducing the pressure (94 mmHg) applied to liquid nitrogen. Nitrogen under the triple point condition is most probably found in a sherbet-like state, where pieces of solid nitrogen are scattered in liquid nitrogen. Meanwhile the melting point of nitrogen under the atmospheric pressure is approximately 63.9 K. and nitrogen under a condition where it exists in both solid and liquid states can be obtained by cooling it with freezing means. The temperature of a substance can be kept constant without difficulty under a condition where both solid and liquid phases coexist because of latent heat involved in phase transition from solid to liquid. Moreover the superconducting body can be effectively and efficiently cooled under such a condition because the body is in contact with liquid. One of the advantages of cooling a superconducting body by nitrogen under the triple point condition is that it can be cooled in a relatively simple manner by using pumping means for reduction of pressure without requiring freezing equipments. On the other hand it is advantageous to cool a superconducting body by liquid nitrogen at its melting point under the atmospheric pressure because the use of a vacuum vessel is not required and hence the structure of the coil container can be relatively simple.

A QMG material normally shows a Jc level at 63.1 K. (or 63.9 K.) which is twice to three times as high as its level at 77 K. and close to 80,000 A/cm$^2$ in a magnetic field of 1 T to prove itself twice as effective as it is at 77 K. in generating a magnetic field. It may be safely said that such a material can be applied to a variety of technical fields.

Figure 2:
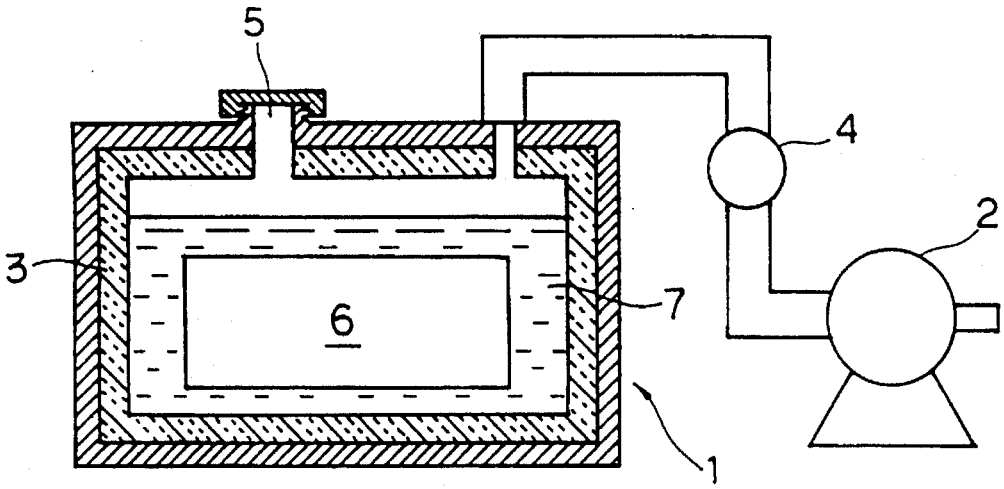

FIG. 2 shows a crosssectional view of an apparatus according to the invention for cooling a superconducting body to the triple point of nitrogen by reducing the pressure of liquid nitrogen. The apparatus comprises a coil container 1, an oxide superconducting body 6 therein and a vacuum pump 2 The coil container 1 is made strong enough to withstand any vacuum condition inside the container. The interior of the coil container 1 is coated with a layer of a thermally insulating material 3 to provide the container width a certain degree of thermal insulation. Liquid nitrogen is introduced into the container 1 under the atmospheric pressure by way of a liquid nitrogen inlet port 5 disposed at the top of the container 1 and, after the inlet port 5 is closed with a cap, the valve 4 of the vacuum pump 2 is opened to bring the inside of the coil container 1 into communication with the vacuum pump 2 ,and the inside temperature of the coil container can be held at desired temperature between 77 K. and 63.1 K. by controlling the inside pressure. When the triple point temperature of nitrogen is reached by reducing the inside pressure, that temperature can be very stably maintained because this temperature is inherent to the material.

Figure 1:
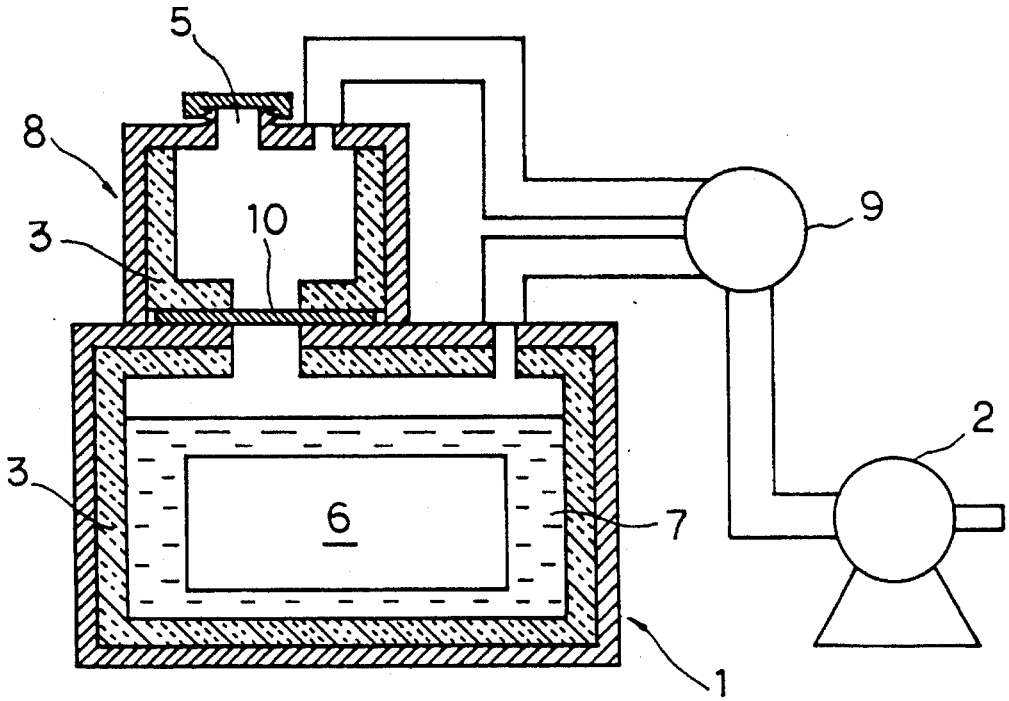
FIGS. 1 through 4 are schematic sectional views of different embodiments of apparatus for cooling an oxide superconducting coil according to the invention.

The inventor of the present invention have developed a method and an apparatus for cooling a superconducting body for a prolonged period of time by utilizing the triple point condition of nitrogen. FIG. 1 shows a cross sectional view of such an apparatus. Like the apparatus of FIG. 2 described above, it comprises a coil container 1 which is connected to a vacuum pump 2 by way of a valve 9 but, unlike the apparatus of FIG. 2, it additionally comprises a prevacuum chamber 8 which is disposed adjacent to the coil container 1 and also connected to the vacuum pump 2 by way of the valve 9. Supply of nitrogen is indispensable to keep cooling a superconducting coil in the coil container for a prolonged period of time, but the inside temperature of the coil container is undesirably raised if liquid nitrogen under the atmospheric pressure is supplied to the coil container. Then the prevacuum chamber 8 temporarily receives supplied liquid nitrogen by way of the liquid nitrogen supply port 5 and lowering the temperature of the supplied liquid nitrogen to that of the liquid nitrogen in the coil container by reducing the pressure applied thereto, so that sufficiently cooled liquid nitrogen can be supplied to the coil container 1 by removing the partition 10 separating the coil container 1 and the prevacuum chamber 8. It may be understood that, with such an arrangement, liquid nitrogen can be supplied to the coil container under constant temperature, so the superconducting coil can be maintained to that low temperature for a prolonged period of time.

Figure 3:
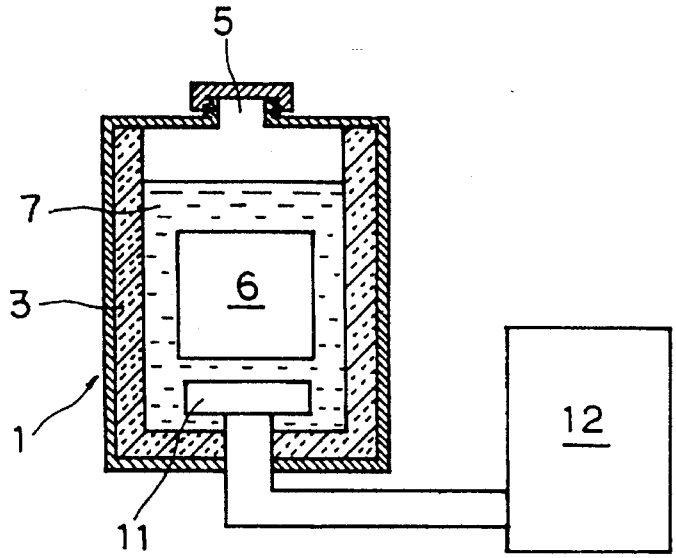

FIG. 3 shows a crosssectional view of an apparatus according to the invention that is adopted to utilize latent heat between liquid and solid phases under the atmospheric pressure. This apparatus comprises a coil container 1 and a freezer 12 having a cooling section 11 housed in the coil container 1 so that the liquid nitrogen contained in the coil container 1 can be cooled under the atmospheric pressure to the temperature where both liquid and solid phase of nitrogen coexist (melting point). The interior of the coil container 1 is coated with a layer of a thermally insulating material 3 to provide the container with a certain degree of thermal insulation. With such an arrangement the inside temperature of the coil container can be controlled between 77 K. and approximately 63.9 K. by operating the freezer, after feeding the container with liquid nitrogen through a liquid nitrogen inlet port 5 disposed at the top of the container under atmospheric pressure. By this method the inside of the coil container can be cooled stably by utilizing latent heat between liquid and solid phases.

Figure 4:
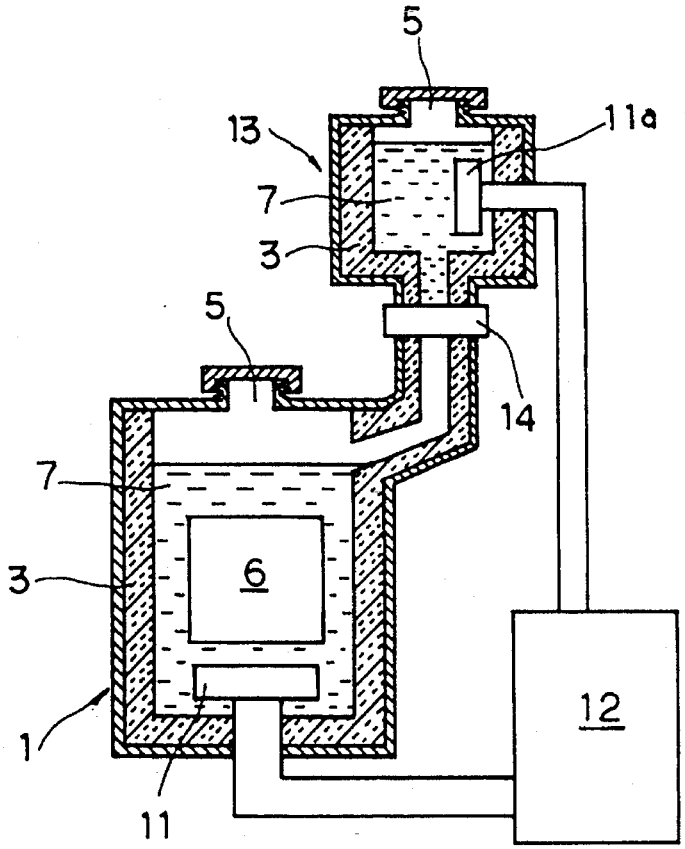

FIG. 4 is a crosssectional view of an apparatus according to the invention adopted to maintain the temperature of the coil container of the apparatus for a prolonged period of time when the latent heat between liquid and solid phases under the atmospheric pressure is utilized. In this case intrinsically there is no loss of nitrogen due to evaporation unlike the above described apparatus utilizing the triple point condition of nitrogen. But, it is useful to provide the apparatus with means of supplying liquid nitrogen because nitrogen may be slightly lost from time to time when the apparatus is manually or mechanically handled and such tiny losses of nitrogen may add up to a significant volume over a prolonged period of time. The apparatus of FIG. 4 comprises a coil container 1 and a freezer 12 having a cooling section 11 housed in the coil container 1 so that the liquid nitrogen 7 contained in the coil container 1 can be cooled as in the case of the apparatus of FIG. 3. Additionally, it comprises a precooling chamber 13 that also contains in it another cooling section 11*a* of the freezer 12 for cooling nitrogen 7 to be supplied to the coil container 1. If liquid nitrogen is supplied directly to the coil container 1 at 77 K., the inside temperature of the coil container 1 is raised and the coil container 1 is no longer kept under a thermally stable condition. So, the precooling chamber 13 intervenes and temporarily receives liquid nitrogen to cool it down to its melting point or the temperature of liquid nitrogen in the coil container before it is supplied to the coil container 1 by opening the valve 14. The arrangement of a precooling chamber ensures supply of liquid nitrogen in constant temperature and prolonged cooling operation.

The inventor of the present invention also developed methods for preventing the occurrence of flux creep which is specific to superconducting magnet, utilizing the above described cooling methods of either using the triple point of nitrogen or using latent heat between solid and liquid under the atmospheric pressure. Flux creep is a phenomenon that gradually attenuates the magnetic field of superconducting magnet in proportion to the logarithm of time if it is driven to operate under a permanent electric current condition. This phenomenon gives rise to a serious problem to an oxide superconducting body which is used at relatively high temperature because it is caused by moving quantized magnetic flux which is activated by heat. The principle underlying this method will be described below by using a Bean's critical state model.

Figure 5:
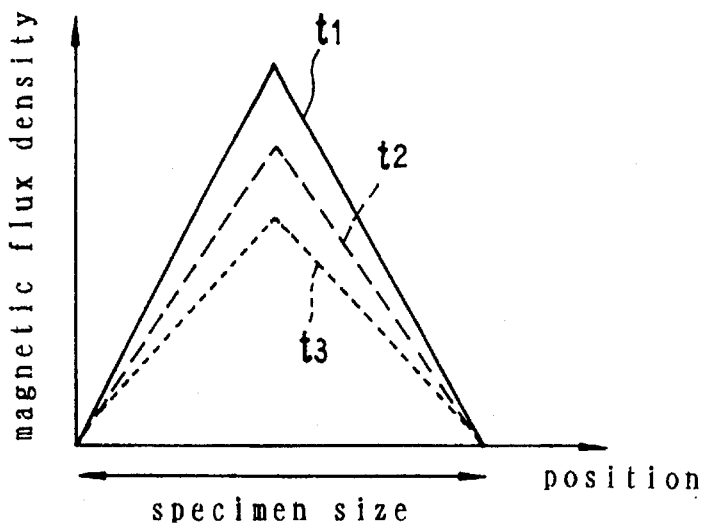
FIG. 5 is a graph schematically showing the condition of magnetic flux in a superconducting body.
Figure 6:
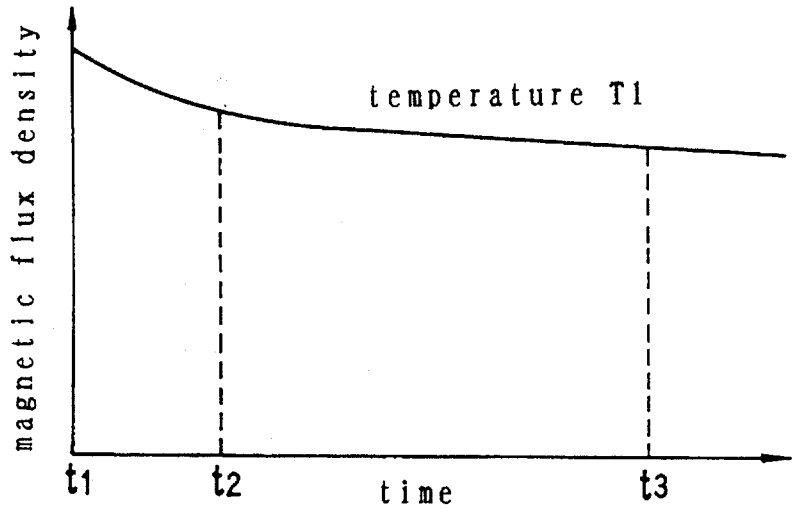
FIG. 6 is a graph illustrating how the magnetic flux density reduces with time in a superconducting body.

FIG. 5 schematically shows how the magnetic flux density attenuates with time in a superconducting body. The solid line in FIG. 5 indicates the condition of the magnetic flux in a superconducting body at time t1 soon after it was magnetically excited at a certain temperature (T1) which is not higher than Tc, whereas the broken lines respectively indicate the conditions of the magnetic flux after time t2 and time t3 if the temperature is kept to T1. This result coincides with the fact that the maximum superconductive current that can afford the superconducting body at the temperature T1 decreases in proportion to the logarithm of time. FIG. 6 shows this decrease in the maximum superconductive current with time. Such decrease in the maximum electric current inevitably results, in practical applications, in undesirable attenuation of magnetic flux of magnets or that of buoyancy of bearings. However, this phenomenon of flux creep in a superconducting body can be prevented by cooling it to temperature T2 which is lower than temperature T1 at which the body has been magnetically excited, so that the maximum electric current density that the superconducting body can afford may be raised to a level where a critical state of the superconducting body can be avoided.

Figure 7:
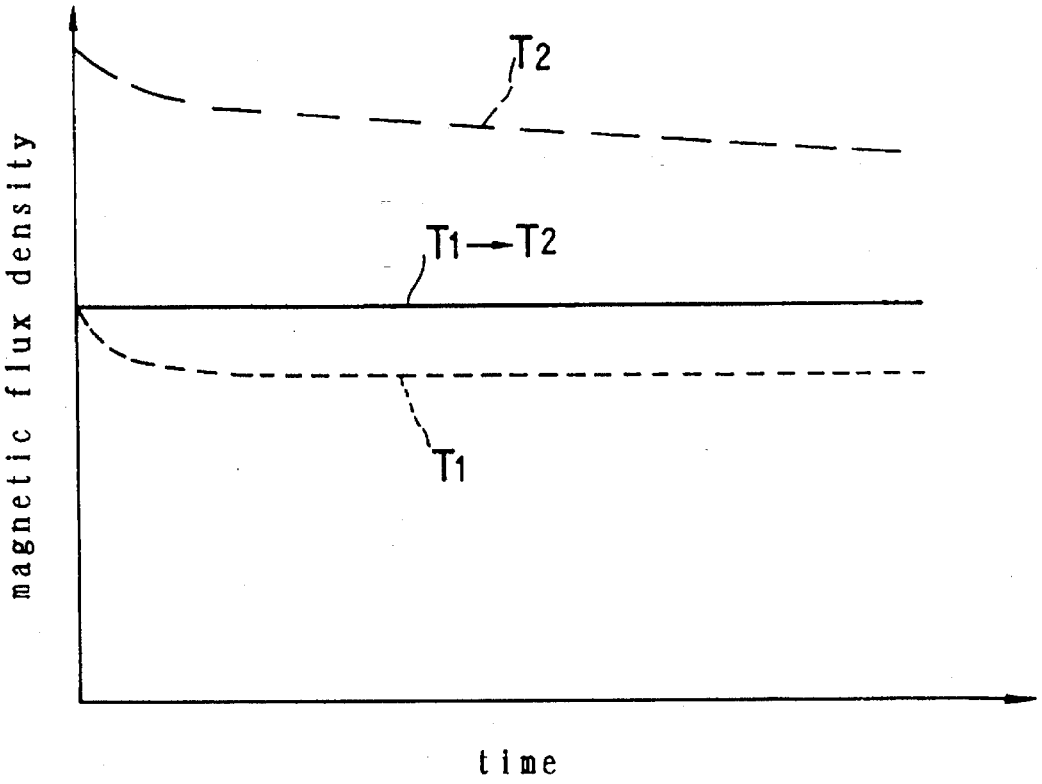
FIG. 7 is a schematic illustration showing how the creep phenomenon of magnetic flux is avoided in a superconducting conducting coil according to the invention.

In FIG. 7, the dot line and the broken line respectively indicate the distributions of magnetic flux of a superconducting body after the magnetic excitation of the body at temperature T1 and at temperature T2 lower than T1. By cooling a superconducting magnet that has been magnetically excited at temperature T1 to temperature T2 which is lower than T1, the capacity of the magnet for electric current is boosted to the critical current shown by the broken line in FIG. 7. Consequently if the magnet is operated at a level lower than the critical current, the attenuation in the magnetic flux density which will occur at T1 temperature as shown by the dot line in FIG. 7 is avoided as indicated by the solid line. In other words, the coil of the magnet is magnetically excited either at temperature higher than the triple point temperature of nitrogen or at the temperature at which both solid and liquid phases of nitrogen coexist under the atmospheric pressure, and thereafter it is cooled to either temperature to avoid magnetic flux creep.

Figure 9:
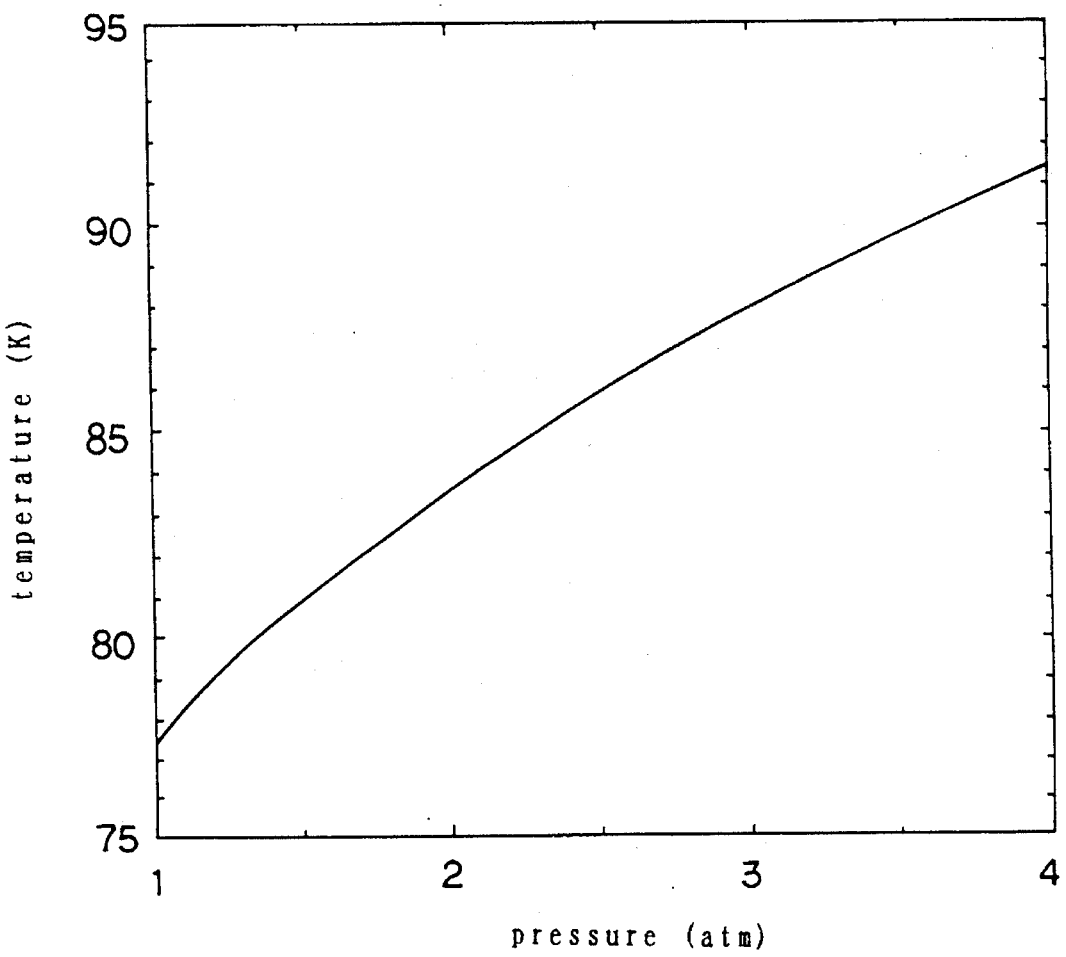
FIG. 9 is a graph showing the relationship between the ambient pressure and the boiling point of nitrogen.

Although a superconducting body cannot be cooled down below the boiling point of nitrogen, the aim of magnetic flux creep prevention can be attained by a simple method of preliminarily keeping the inside of a coil container over the atmospheric pressure and thereafter leaking or releasing the pressure to cool the magnetically excited superconducting body. Referring to FIG. 9 that illustrates the relationship between the ambient pressure and the boiling point of nitrogen, it will be seen that the boiling point of nitrogen is 77 K. at 1 atmosphere and rises to 92 K. at 4 atmospheres. For the purpose of the present invention, the pressure to be applied to the inside of the coil container will be found within the illustrated range which corresponds to the boiling point of nitrogen up to 92 K.

Example 1

Figure 8:
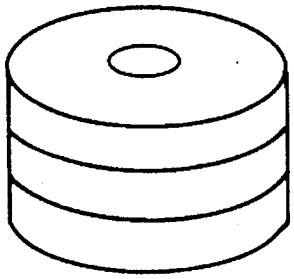
FIG. 8 is a schematic perspective view of a bulk magnet having three windings subjected to an experiment conducted by the inventors for the purpose of the present invention.

A magnet as schematically illustrated in FIG. 8 (which is an equivalent of superconducting coil having three windings) was prepared by using a superconducting material (QMG material) in which fine $RE_2BaCuO_5$ phases having sizes of several μm were dispersed in a pseudo-single crystal $REBa_2Cu_3O_{7-x}$ phase. Y was used for RE in this example (as well as in the following examples). The prepared magnet was then put in a coil container 1 as illustrated in FIG. 2. After filling the coil container with liquid nitrogen, the inside pressure of the coil container was reduced to cool the magnet to 63.1 K. Thereafter, the superconducting coil was magnetically excited by gradually feeding current to 20A from outside while maintaining the inside temperature to 63.1 K. By checking the distribution of magnetic flux in the superconducting coil, it was found that a maximum magnetic flux was obtained which was a significant improvement over the maximum magnetic flux which could be obtained at 77 K. mainly because of the heat generated at the electrical terminals.

A bulk magnet having a height of 15 mm and a diameter of 42 mm (which is an equivalent of a superconducting coil having a single winding) was prepared by using a superconducting material (QMG material) in which fine $RE_2BaCuO_5$ phases having sizes of several μm were dispersed in a pseudo-single crystal $REBa_2Cu_3O_{7-x}$ phase. The prepared magnet was then put in a coil container 1 as illustrated in FIG. 1. It was then subjected to a magnetic field of 2.0 T applied thereto by means of a normal conducting magnet, fed with liquid nitrogen and cooled to 63.1 K. by reducing the inside pressure of the container 1. The superconducting coil was then magnetically excited by removing the external magnetic field and causing it to trap the magnetic flux while keeping the temperature to 63.1 K. After removing the normal conducting magnet, the distribution of the trapped magnetic flux was analyzed to show that a maximum magnetic flux of 1.8 T was obtained 100 seconds after the removal of the magnetic field. Ten hours later, the prevacuum chamber 8 was fed with liquid nitrogen and the inside temperature was lowered to 63.1 K. by reducing the inside pressure to obtain cooled liquid nitrogen which is then supplied to the superconducting coil container 1. The magnetic field generated by the superconducting coil did not show any fluctuation before and after the supply of liquid nitrogen at the constant temperature of 63.1 K.

Example 3

A bulk magnet having a height of 15 mm and a diameter of 42 mm (which is an equivalent of a superconducting coil having a single winding) was prepared by using a superconducting material (QMG material) in which fine $RE_2BaCuO_5$ phases having sizes of several μm were dispersed in a pseudo-single crystal $REBa_2Cu_3O_{7-x}$ phase. The prepared magnet was then put in a coil container 1 as illustrated in FIG. 2. After feeding the coil container 1 with liquid nitrogen, the inside temperature of the container 1 was lowered to 63.1 K. by reducing the inside pressure. Then, a ring-shaped SmCo type permanent magnet was brought very close to the superconducting coil until they were separated from each other only by 0.8 mm while keeping the temperature to 63.1 K. It was proved by placing a weight on the permanent magnet that a buoyance (repellent force) of 20 kg was exerted to the permanent magnet under this condition. The buoyance can be deemed as a proof that a superconductive current was running through the superconducting coil and therefore the superconducting coil was being magnetically excited.

Example 4

A magnet as schematically illustrated in FIG. 8 (which is an equivalent of a superconducting coil having three windings) was prepared by using a superconducting material (QMG material) in which fine $RE_2BaCuO_5$ phases having sizes of several μm were dispersed in a pseudo-single crystal $REBa_2CuaO_{7-x}$ phase. The prepared magnet was then put in a coil container 1 as illustrated in FIG. 3. After feeding the coil container 1 with liquid nitrogen, the inside temperature of the container 1 was lowered to 63.9 K. by the freezer. Thereafter, the superconducting coil was magnetically excited by gradually feeding current to 20A from outside while maintaining the inside temperature to 63.9 K. By checking the distribution of magnetic flux in the superconducting coil, it was found that a maximum magnetic flux was obtained which was a significant improvement over the maximum magnetic flux which could be obtained at 77 K. mainly because of the heat generated at the electrical terminals.

Example 5

A bulk magnet having a height of 15 mm and a diameter of 42 mm (which is an equivalent of a superconducting coil having a single winding) was prepared by using a superconducting material (QMG material) in which fine $RE_2BaCuO_5$ phases having sizes of several μm were dispersed in a pseudo-single crystal $REBa_2Cu_3O_{7-x}$ phase. The prepared magnet was then put in a coil container 1 as illustrated in FIG. 4. It was then subjected to a magnetic field of 2.0 T applied thereto by means of a normal conducting magnet, fed with liquid and cooled to 63.9 K. by the freezer. The superconducting coil was then magnetically excited by removing the external magnetic field and causing it to trap the magnetic flux while keeping the temperature to 63.9 K. After removing the normal conducting magnet, the distribution of the trapped magnetic flux was analyzed to show that a maximum magnetic flux of 1.8 T was obtained 100 seconds after the removal of the magnetic field. Hundred hours later, the prevacuum chamber 13 was fed with liquid nitrogen and the inside temperature was lowered to 63.9 K. by the freezer to obtain cooled liquid nitrogen which is then supplied to the superconducting coil container 1. The magnetic field generated by the superconducting coil did not show any fluctuation before and after the supply of liquid nitrogen at the constant temperature of 63.9 K.

Example 6

A bulk magnet having a height of 15 mm and a diameter of 42 mm (which is an equivalent of a superconducting coil having a single winding) was prepared by using a superconducting material (QMG material) in which fine $RE_2BaCuO_5$ phases having sizes of several μm were dispersed in a pseudo-single crystal $REBa_2Cu_3O_{7-x}$ phase. The prepared magnet was then put in a coil container 1 as illustrated in FIG. 3. After feeding the coil container 1 with liquid nitrogen, the inside temperature of the container 1 was lowered to 63.9 K. by the freezer. Then, a ring-shaped SmCo type permanent magnet was brought very close to the superconducting coil until they were separated from each other only by 0.8 mm while keeping the temperature to 63.9 K. It was proved by placing a weight on the permanent magnet that a buoyance (repellent force) of 20 kg was exerted to the permanent magnet under this condition. The buoyance can be deemed as a proof that a superconductive current was running through the superconducting coil and therefore the superconducting coil was being magnetically excited.

Example 7

A bulk magnet having a height of 15 mm and a diameter of 42 mm (which is an equivalent of a superconducting coil having a single winding) was prepared by using a superconducting material (QMG material) in which fine $RE_2BaCuO_5$ phases having sizes of several μm were dispersed in a pseudo-single crystal $REBa_2Cu_3O_{7-x}$ phase. The prepared magnet was then put in a coil container 1 as illustrated in FIG. 1. It was then subjected to a magnetic field of 2.0 T applied thereto by means of a normal conducting magnet, fed with liquid nitrogen and cooled to 70 K. by reducing the inside pressure of the container 1. The superconducting coil was then magnetically excited by removing the external magnetic field and causing it to trap the magnetic flux while keeping the temperature to 70 K. After removing the normal conducting magnet, the distribution of the trapped magnetic flux was analyzed to show that a magnetic flux of 1.10 T and that of 1.07 T were obtained respectively 200 seconds and 1,000 seconds after the removal of the normal conducting magnet. From these, it was found that it has a standardized attenuation rate of $2.7\times10^{-2}$.

After the magnetic excitation, an experiment for cooling the superconducting coil to 63.1 K. was conducted in a manner as described below. Firstly, the same superconducting coil was placed in the coil container and a magnetic field of 2.0 T was applied thereto by means of a normal conducting magnet. Then, liquid nitrogen was fed into the container and the inside temperature of the container was lowered to 70 K. by reducing and controlling the inside pressure. Thereafter, the superconducting coil was magnetically excited by removing the external magnetic field and causing it to trap the magnetic flux while keeping the temperature to 70 K. The distribution of the trapped magnetic flux was analyzed to show a magnetic flux of 1.100 T 200 seconds after the removal of the normal conducting magnet. Then, the inside temperature of the container was set to 63.1 K. by reducing the inside pressure over 60 seconds. The magnetic flux density was 1.095 T under this condition. 2,000 seconds later, the magnetic flux density was found to remain at the level of 1.095 T and no creep was observed in the magnetic flux within the allowable limit of error.

Example 8

A bulk magnet having a height of 20 mm and a diameter of 52 mm (which is an equivalent of a superconducting coil having a single winding) was prepared by using a superconducting material (QMG material) in which fine $RE_2BaCuO_5$ phases having sizes of several μm were dispersed in a pseudo-single crystal $REBa_2Cu_3O_{7-x}$ phase. The prepared magnet was then put in a container that withstands inside pressure (pressure chamber) It was then subjected to a magnetic field of 2.0 T applied thereto by means of a normal conducting magnet, fed with liquid nitrogen and cooled to 84 K. under pressure of 2 atmospheres. The superconducting coil was then magnetically excited by removing the external magnetic field and causing it to trap the magnetic flux while keeping the temperature to 84 K. After removing the normal conducting magnet, the distribution of the trapped magnetic flux was analyzed to show that a magnetic flux of 0.68 T and that of 0.64 T were obtained respectively 200 seconds and 1,000 seconds after the removal of the normal conducting magnet.

After the magnetic excitation the pressure of the pressure chamber was released to the atomospheric pressure, then an experiment for cooling the superconducting coil to 77 K. was conducted in a manner as described below. Firstly, the same superconducting coil was placed in the pressure chamber and a magnetic field of 2.0 T was applied thereto by means of a normal conducting magnet. Then, liquid nitrogen was fed into the container and the inside temperature of the container was lowered to 84 K. by controlling the inside pressure over the atmospheric pressure. Thereafter, the superconducting coil was magnetically excited by removing the external magnetic field and causing it to trap the magnetic flux while keeping the temperature to 84 K. The distribution of the trapped magnetic flux was analyzed to show a magnetic flux of 0.68 T 200 seconds after the removal of the normal conducting magnet. Then, the inside temperature of the container was lowered to 77 K. by reducing the inside pressure over 5 seconds. The magnetic flux density was 0.68 T under this condition (205 seconds after the removal of the magnetic field). 2,000 seconds later, the magnetic flux density was found to remain at the level of 0.68 T and no creep was observed in the magnetic flux within the allowable limit of error.

Industrial Applicability

As described above in detail, according to the invention, method and apparatus are provided for cooling an oxide superconducting body to approximately 63 K. and stably keeping the superconducting body to that temperature by using liquid nitrogen in an easy manner. Thus, the present invention has significantly broadened the scope of applicability of an oxide superconducting body. The present invention also provides an effective technique of preventing the creep phenomenon in the magnetic flux to establish a stable way of magnetization. Therefore, a method of cooling a superconducting body according to the invention has an immense industrial applicability.

I claim:

1. A method for cooling an oxide superconducting coil and stably maintaining the oxide superconducting coil at constant temperature, comprising steps of introducing liquid nitrogen into a coil container, and reducing the inside pressure of the coil container by pumping means to cool the nitrogen to the triple point temperature 63.1 K.

2. A method for cooling an oxide superconducting coil and stably maintaining the oxide superconducting coil at constant temperature for a prolonged period of time, comprising steps of introducing liquid nitrogen into a coil container, reducing the inside pressure of the coil container by pumping means to cool the nitrogen to the triple point temperature 63.1 K., stably maintaining the superconducting coil at that temperature, introducing liquid nitrogen into a prevacuum chamber, reducing the inside pressure of the prevacuum chamber to cool the nitrogen to the triple point temperature and the coil container being repeatedly supplied with the additional cooled nitrogen of the prevacuum chamber.

3. A method for cooling an oxide superconducting coil by using liquid nitrogen and avoiding magnetic flux creep phenomenon comprising steps of magnetically exciting the superconducting coil in a coil container which is maintained above 63.1 K. by adjusting the inside pressure of the coil container, and lowering thereafter the inside temperature of the coil container to 63.1 K. by reducing the inside pressure.

4. A method for cooling an oxide superconducting coil and stably maintaining the oxide superconducting coil at constant temperature, comprising steps of introducing liquid nitrogen into a coil container, and thereafter cooling the inside of the container by freezing means near to the melting point 63.9 K. of nitrogen under the atmospheric pressure.

5. A method for cooling an oxide superconducting coil by using liquid nitrogen under the atmospheric pressure and avoiding magnetic flux creep phenomenon, comprising steps of magnetically exciting the superconducting coil in a coil container which is maintained above 63.9 K. by adjusting the inside temperature of the coil container by freezing means, and thereafter reducing the inside temperature of the coil container near to 63.9 K.

6. The method according to claim 1, for stably maintaining the oxide superconducting coil at constant temperature for a prolonged period of time, further comprising the additional steps of introducing liquid nitrogen into a prevacuum chamber, reducing inside pressure of the prevacuum chamber to cool the nitrogen to triple point temperature, and repeatedly supplying the coil container with additional cooled nitrogen from the prevacuum chamber.

* * * * *

UNITED STATES PATENT AND TRADEMARK OFFICE

CERTIFICATE OF CORRECTION

PATENT NO. : 5,477,693

DATED : December 26, 1995

INVENTOR(S) : Mitsuru MORITA

It is certified that error appears in the above-indentified patent and that said Letters Patent is hereby corrected as shown below:

Title page, item [57], ABSTRACT, line 1, change "cooling an superconducting" to --cooling a superconducting--.

Title page, item [57], ABSTRACT, line 7, delete "by" at end of line.

Column 1, line 23, change "conduct ion" to --conduction--.

Column 1, line 47, insert --the-- between "in" and "near".

Column 2, line 62, change "tinder" to --under--.

Column 3, line 25, before "coexist" insert --to--.

Column 3, line 44, change "equipments" to --equipment.--

Column 3, line 62, change "pump 2 The" to --pump 2. The--.

Column 3, line 65, change "width" to --with--.

UNITED STATES PATENT AND TRADEMARK OFFICE

CERTIFICATE OF CORRECTION

PATENT NO. : 5,477,693

DATED : December 26, 1995

INVENTOR(S) : Mitsuru MORITA

It is certified that error appears in the above-indentified patent and that said Letters Patent is hereby corrected as shown below:

Column 4, line 11, change "have" to --has--.

Column 4, line 35, change "to" to --at--.

Column 5, line 17, change "in" to --at--.

Column 5, line 18, before "prolonged" insert --a--.

Column 6, line 26, before "superconducting" insert --a--.

Column 6, lines 43 and 44, between paragraph ending with "electrical terminals." and paragraph beginning "A bulk magnet having...", insert --Example 2-- as a heading.

Column 6, line 46, change "supero-" to --super--.

Column 7, line 57, after "liquid" insert --nitrogen--.

Signed and Sealed this

First Day of October, 1996

Bruce Lehman

*Attest:*

BRUCE LEHMAN

*Attesting Officer*

*Commissioner of Patents and Trademarks*